United States Patent [19]

Nafziger

[11] 4,107,796

[45] Aug. 22, 1978

[54] FLUSH TANK SYSTEM

[76] Inventor: Joel L. Nafziger, R.R. 1, Hopedale, Ill. 61747

[21] Appl. No.: 779,049

[22] Filed: Mar. 18, 1977

[51] Int. Cl.[2] ..... E03D 1/20

[52] U.S. Cl. ..... 4/353; 4/365

[58] Field of Search ..... 4/1, 10, 18 R, 32, 33, 4/176, 178; 222/463, 604, 166; 259/75; 74/422; 214/312-314, 318

[56] References Cited

U.S. PATENT DOCUMENTS

| | | | |
|---|---|---|---|
| 3,201,224 | 8/1965 | Grim | 22/604 |
| 3,412,904 | 11/1968 | Chupka | 222/604 |

FOREIGN PATENT DOCUMENTS

| | | | |
|---|---|---|---|
| 7,145 of | 1891 | United Kingdom | 4/32 |

*Primary Examiner*—Harry N. Haroian
*Attorney, Agent, or Firm*—Fraser and Bogucki

[57] ABSTRACT

A flush tank system includes an elongated tank supported at the opposite ends thereof by a pair of arcuate-shaped rockers which rest on the upper surfaces of a pair of support frames. The tank normally assumes an upright position with one of a pair of relatively slightly curved portions of each rocker resting on top of the support frames when the tank is empty and when the tank is being filled with a fluid such as water through an opening in the top thereof. The non-uniform cross-section of the tank causes the center of gravity of the water to shift laterally to a point at which the opposite rockers roll from the relatively slightly curved portion on which they are resting over a relatively greatly curved portion thereof to the other relatively slightly curved portion, thereby rapidly rotating the tank into a tipped position and pouring the water out of the tank opening. With the water discharged from the tank, the tank rotates back to the upright position where refilling of the tank with water may be resumed.

16 Claims, 8 Drawing Figures

Fig. 2
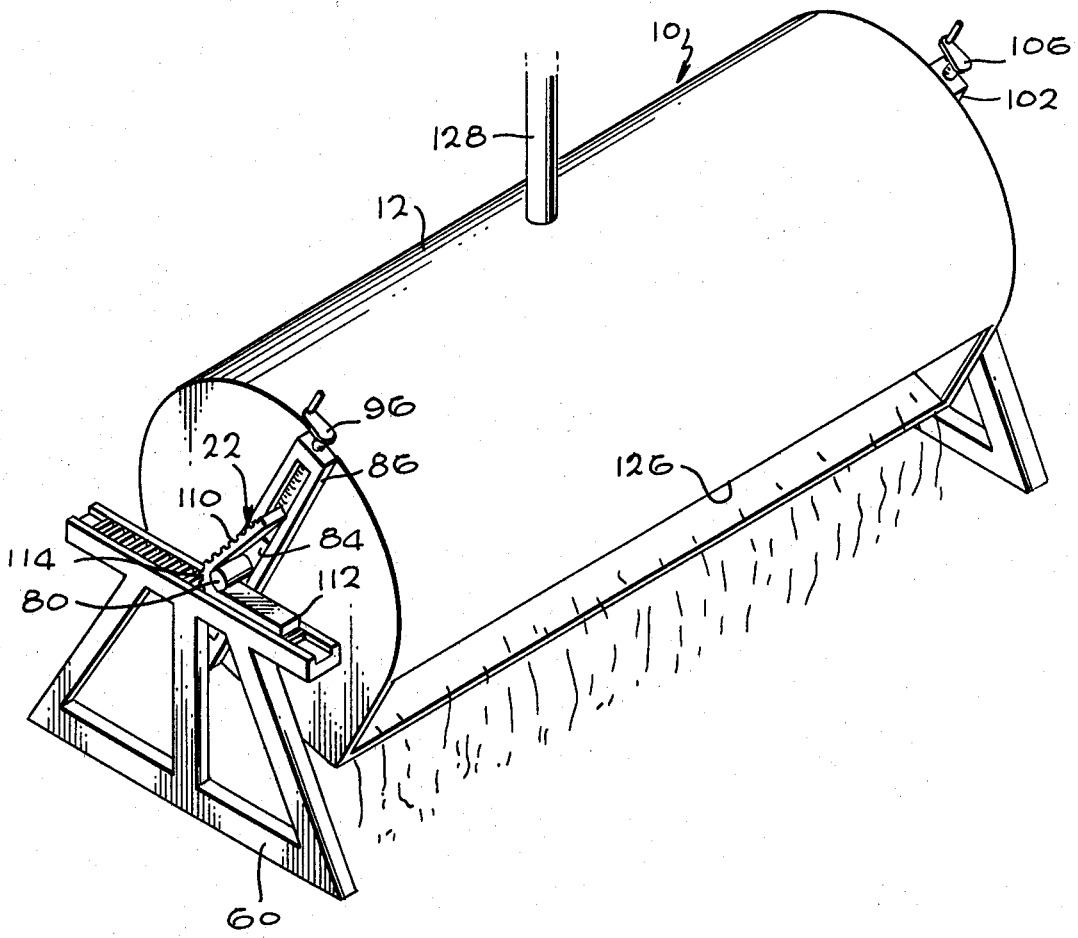
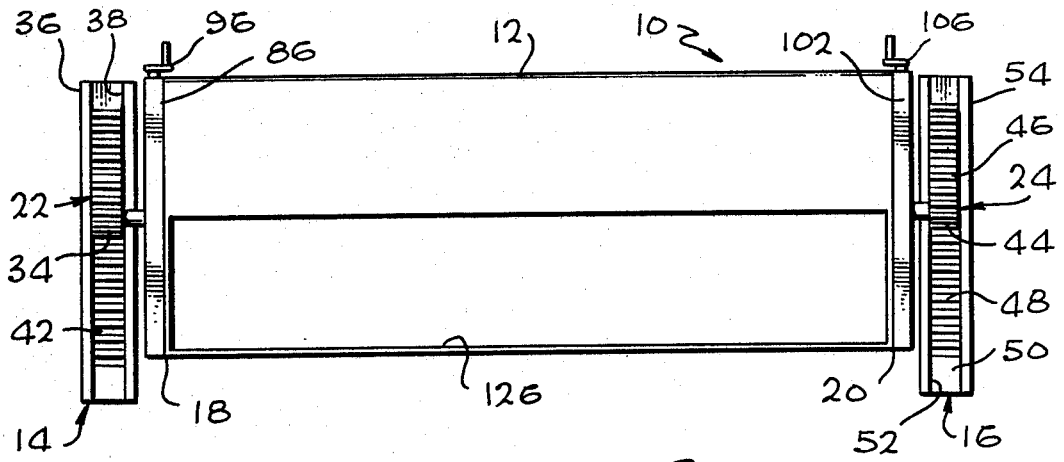
Fig. 3

FLUSH TANK SYSTEM

BACKGROUND OF THE INVENTION

1. Field of the Invention

The present invention relates to flush tank systems, and more particularly to systems of the type in which a tank is repeatedly filled with a fluid such as water and emptied by action of the weight of the water within the tank.

2. History of the Prior Art

It is known in the art to provide flush tank systems of the type which are repeatedly filled with water and are emptied of the water by action of the weight of the water within the tank. In a typical installation the tank which is of elongated configuration and which has an opening extending along the length thereof is mounted at the opposite ends for rotation about a generally horizontal axis. A hose or other discharge device located above the tank opening provides a continuous supply of water to the inside of the tank. The cross-sectional shape of the tank is non-uniform and is configured so that as the water level rises within the tank, the center of gravity of the water shifts. Eventually a point is reached at which the tank suddenly rotates from the upright position into a tipped position in which the opening in the tank moves to the bottom of the tank and the water is quickly discharged through the opening. With the tank emptied the weight thereof causes rotation of the tank back to the upright position. Tanks of this type are useful in a number of applications, such as farm animal waste systems which often require a periodic sudden discharge of a large volume of water. Examples of flush tank systems and related systems are provided by U.S. Pat. Nos. 1,613,640 of Bartosik, 668,853 of Gatling, 228,264 of McFarland and 724,299 of Knobel.

Prior art flush tank systems typically suffer from a number of disadvantages which may make them expensive, may require a substantial amount of maintenance and may greatly shorten their useful life. The bearings which are often required to rotatably mount the tank at the opposite ends thereof are costly at the outset and may require frequent maintenance or periodic replacement. The design of many systems is such that the dumping action requires use of a bumper mechanism to terminate downward rotation of the tank into the tipped position. Moreover, even where an appropriate mechanism is provided to absorb much of the shock of the tank as it comes to rest in the tipped position, the foundation beneath the tank may eventually be damaged or destroyed and the tank itself may be damaged or worn out prematurely. As the tank dumps the water therefrom and returns to the upright position, many systems require arrangements of springs, bumpers and the like to slow down and terminate movement of the tank, thereby adding to the cost and complexity of the system as well as shortening the useful life of the tank. Some prior art designs require that the tank be of generally trapezoidal cross-section. Such tanks typically experience undesirable load stresses under the weight of the water, which stresses often produce bending of the metal of the tank. The support frames on which the opposite ends of the tank are mounted must typically be of very substantial and heavy duty construction and at that are frequently damaged or worn out prematurely because of the lateral forces exerted thereon due to bumping or stopping of the tank as well as the vertical forces due to the weight of the tank and the water.

Accordingly it is an object of the invention to provide an improved flush tank system.

It is a further object of the invention to provide a relatively low cost flush tank system having a minimum of parts, particularly those which are subject to constant wear and replacement.

It is a still further object of the invention to provide an improved flush tank system in which bumpers, springs and other mechanisms are not required in either the tipped or the upright position and in which the forces exerted on the support frames by the tank are substantially exclusively unidirectional in nature.

BRIEF SUMMARY OF THE INVENTION

Flush tank systems according to the invention mount the tank onto an opposite pair of support frames using generally arcuate-shaped rockers mounted on the opposite ends of the tank. The rockers which rest upon surfaces at the tops of the support frame are configured so as to maintain the tank in an upright position until such time as the water level therein rises to a certain region near the top of the tank. At that point the center of gravity of the tank and included water is laterally shifted by a sufficient amount to cause the rockers to roll into a different position, permitting the tank to rotate into a tipped position for discharge of the water therefrom. When the tank is empty the center of gravity thereof is such as to cause the rockers to roll back into the original position, permitting the tank to rotate back into the upright position. Rotation of the tank into the tipped position occurs abruptly but in controlled and gentle fashion due to the configuration of the rockers and the manner in which they roll upon the mating surfaces of the support frames. Consequently bumpers or other means for limiting or terminating movement of the tank into the tipped position are not necessary. Likewise the tank rotates back into the upright position gently and in controlled fashion without the need for springs, bumpers or other devices.

In a preferred embodiment of a flush tank system according to the invention each bumper is comprised of first and second relatively slightly curved portions on the opposite sides of an intermediate portion of relatively substantial curvature. The rocker rests upon the first relatively slightly curved portion when the tank is in the upright position and is operative to respond to the changing weight and the center of gravity of the tank as it fills with water to roll onto the intermediate portion and then onto the second relatively slightly curved portion to rotate the tank into the tipped position.

The rockers may be mounted on the opposite ends of the tank using adjustable mounting arrangements which permit adjustment of the positions of the rockers laterally across the ends of the tank to vary the tipping action of the tank. The positions of the rockers relative to the ends are made adjustable using threaded shafts or other appropriate means.

To provide positive engagement of the rockers and mating upper surfaces of the support frames, the surfaces of the support frames and the outer surfaces of the rockers may be provided with teeth.

BRIEF DESCRIPTION OF THE DRAWINGS

The foregoing and other objects, features and advantages of the invention will be apparent from the following more particular description of preferred embodiments of the invention, as illustrated in the accompanying drawings, in which:

FIG. 2 is a perspective view of the flush tank system of FIG. 1 showing the tank thereof in a tipped position;

FIG. 3 is a top view of the flush tank system of FIG. 1;

DETAILED DESCRIPTION

Figure 1:
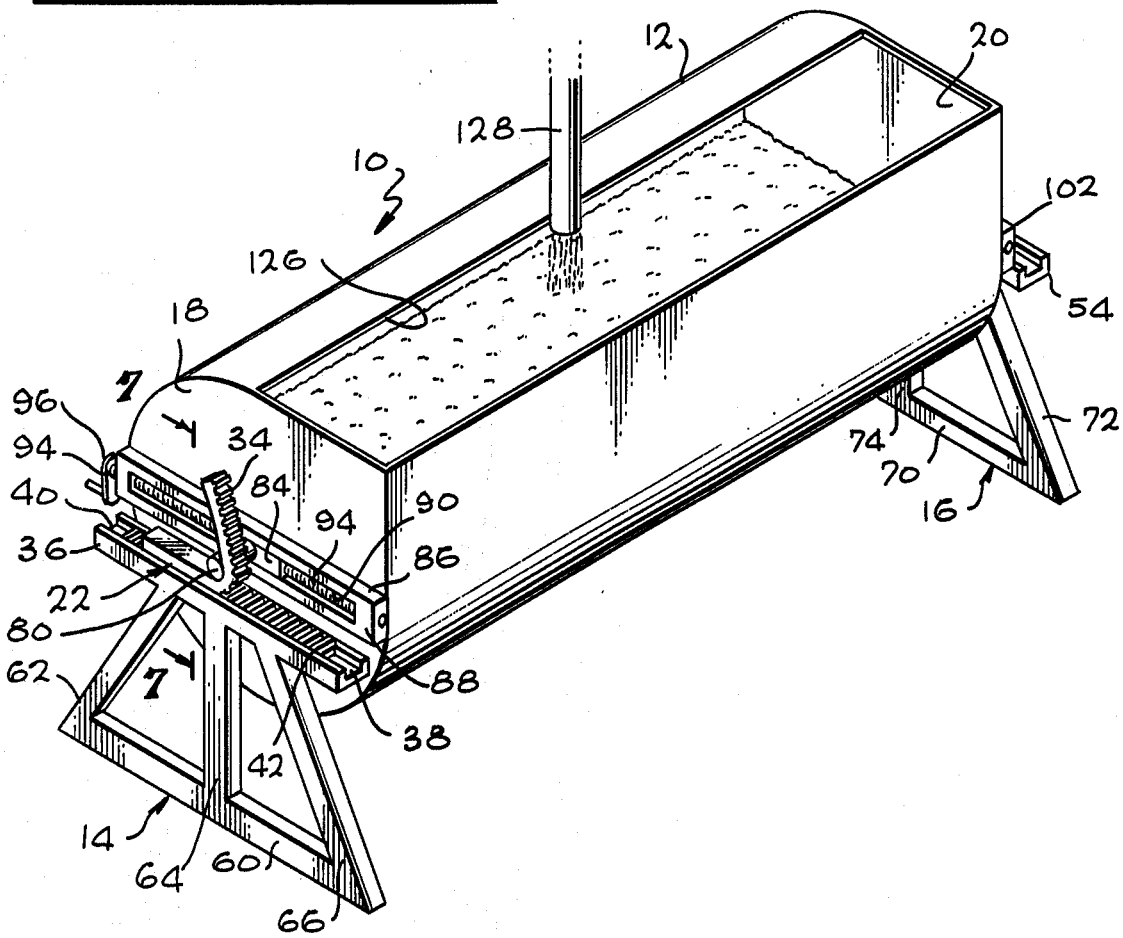
FIG. 1 is a perspective view of a flush tank system in accordance with the invention showing the tank in an upright position.
Figure 4:
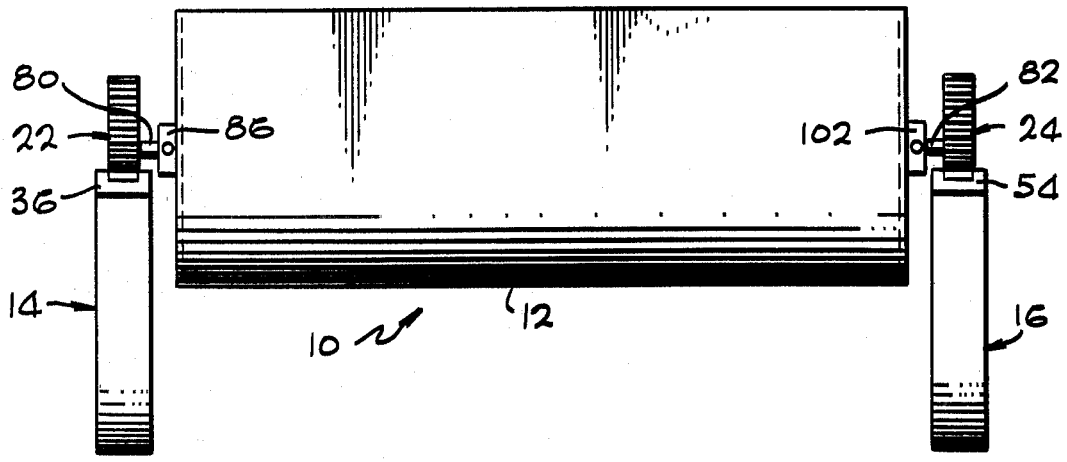
FIG. 4 is a front view of the flush tank system of FIG. 1.
Figure 5:
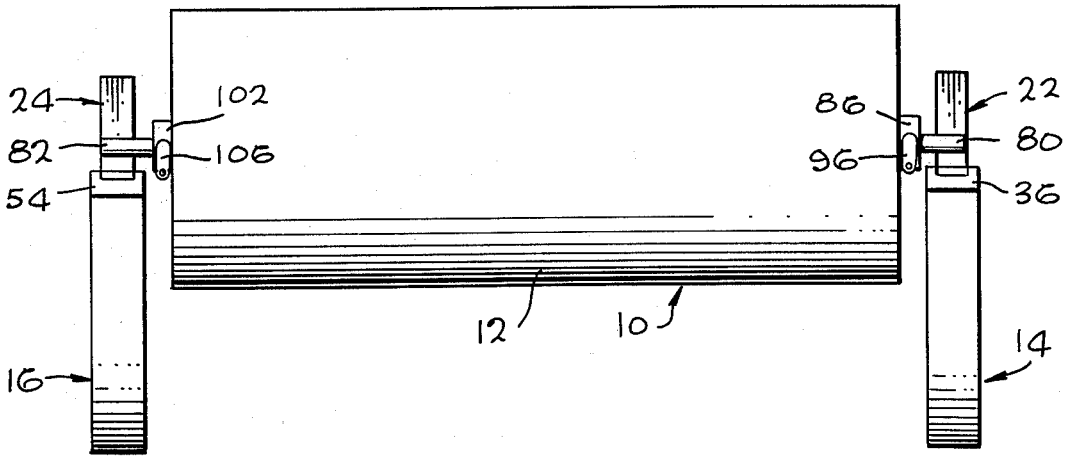
FIG. 5 is a rear view of the flush tank system of FIG. 1.
Figure 6:
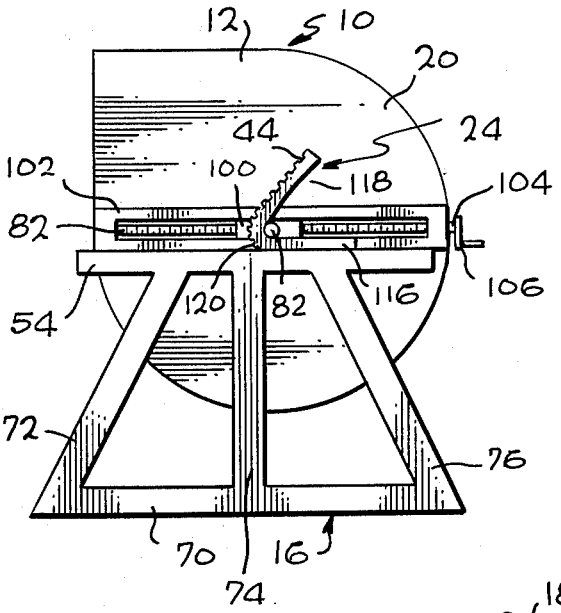
FIG. 6 is a right end view of the flush tank system of FIG. 1.

FIG. 1 shows a flush tank system 10 in accordance with the invention as including a tank 12, a left support frame 14 and a right support frame 16. The tank 12 is elongated and of generally uniform cross-section and has opposite ends 18 and 20 disposed adjacent the support frames 14 and 16 respectively. An arcuate-shaped rocker 22 is mounted on the end 18 and rests on the top of the support frame 14. As shown in FIG. 6 the right end 20 of the tank has a rocker 24 of shape similar to the rocker 22 mounted thereon and supported on the right support frame 16.

The rocker 22 which is made of steel or other appropriate material has a generally uniform thickness between opposite inner and outer surfaces 30 and 32 respectively. The outer surface 32 is provided with a plurality of teeth 34. The support frame 14 which is of relatively thin, generally planar configuration and generally vertically disposed and which may be made of concrete, wood, steel or other appropriate material includes a top beam 36 generally horizontally disposed and having a groove 38 therein extending along the length thereof and having a bottom surface 40 defining a top surface of the support frame 14 which is adapted to receive the rocker 22. The surface 40 is provided with a plurality of teeth 42 preferably of steel or similar composition and adapted to matingly engage with the teeth 34 of the rocker 22. As seen in FIG. 3 the right hand rocker 24 is provided with teeth 44 at an outer surface 46 thereof for engagement with teeth 48 at a surface 50 within a groove 52 within a top beam 54 comprising a part of the right hand support frame 16.

In addition to the top beam 38, the support frame 14 is comprised of a bottom beam 60 and three different legs 62, 64 and 66. The legs 62, 64 and 66 extend between the bottom beam 60 and the top beam 36 with the outside legs 62 and 66 extending slightly inwardly as well as upwardly so as to enhance the lateral support capability of the support frame 14. The support frame 16 is of like construction and, as shown in FIG. 6, includes a bottom beam 70 and legs 72, 74 and 76.

Figure 7:
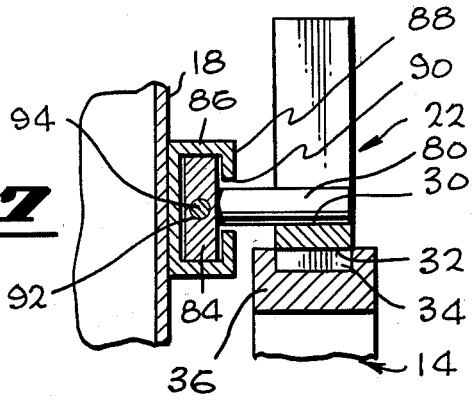
FIG. 7 is a sectional view of a portion of the flush tank system of FIG. 1 taken along the line 7—7 thereof.

The rocker 22 is mounted on the end 18 of the tank 12 by an elongated shaft 80 of steel or similar material extending in the direction of the elongation or axis of elongation of the tank 12. The side surface of the shaft 80 adjacent the outer end thereof is secured such as by welding to a portion of the inner surface 30 of the rocker 22. In like fashion an elongated shaft 82 is mounted on the opposite end 20 of the tank 12 and is coupled to the inner surface of the rocker 24. The shaft 80 is secured to a central portion of a plate 84 of steel or similar material disposed within a housing 86 mounted on the end 18 of the tank 12. As shown in FIG. 7 the housing 86 which is of steel or similar material is hollow and has an interior, the width of which is slightly larger than the width of the plate 84 to permit sliding movement of the plate 84 along the length of the housing 86. A front portion 88 of the housing 86 has an opening 90 along the length of the housing 86. The opening 90 has a width less than that of the plate 84 but great enough to permit the shaft 80 to extend out of the housing 86 and into engagement with the rocker 22.

The plate 84 has a threaded aperture 92 therein for receiving a threaded shaft 94 of steel or similar material. The threaded shaft 94 extends along the length of the housing 86 at the interior thereof and is journaled in the opposite ends of the housing 86. The shaft 94 extends outside of one end of the housing 86 and terminates in a hand crank 96. Operation of the crank 96 rotates the shaft 94 to slide the plate and the included shaft 80 and rocker 22 along the length of the housing 86 in either direction.

The right hand shaft 82 and included rocker 24 are adjustably mounted on the end 20 of the tank 12 by a similar arrangement including a plate 100, a housing 102, a shaft 104 and a crank 106.

The rocker 22 is comprised of opposite portions 110 and 112 of relatively slight curvature joined by an intermediate portion 114 of substantially great curvature. In like fashion the rocker 24 has opposite portions 116 and 118 of relatively slight curvature and an intermediate portion 120 of relatively great curvature. The tank 12 normally rests in an upright position as shown in FIGS. 1 and 3–7 in which the portion 110 of the rocker 22 rests on the support frame 14 and the portion 116 of the rocker 24 rests upon the support frame 16.

The tank 12 is made of steel or similar material and is completely enclosed except for an elongated, generally rectangular opening 126 in the top thereof. A discharge hose, nozzle or other appropriate device 128 is located immediately above the opening 126 with the tank 12 in the upright position. The device 128 discharges a steady stream of fluid such as water through the opening 126 and into the tank 12.

Figure 8:
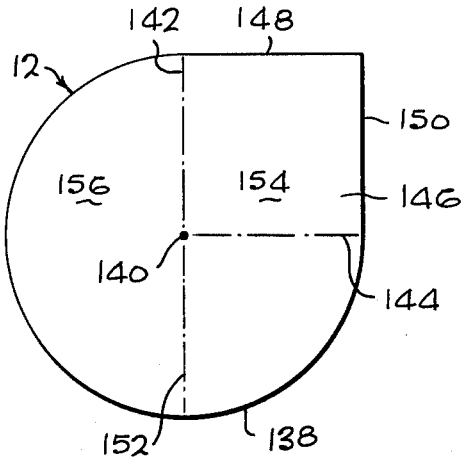
FIG. 8 is an end view of the tank in the flush tank system of FIG. 1.

FIG. 8 shows the cross-sectional shape of the tank 12 which is uniform along the length thereof. The shape is comprised of three-fourths of a circle 138 having its center at an axis of elongation or central axis 140 of the tank 12 and terminating at each of two different dotted lines 142 and 144. The lines 142 and 144 also comprise the inner sides of a square 146 having two outer sides 148 and 150. The outer sides 148 and 150 and the inner sides 142 and 144 of the square 146 are equal to the radius of the circle 138.

The dotted line 142 can be extended through the lower portion of the tank 12 to define a central, generally vertically disposed plane 152 bisecting the tank along the length thereof and lying within the central axis 140. The plane 152 divides the tank 12 into opposite front and back halves 154 and 156 respectively.

The half 154 of the tank 12 has a cross-sectional area at the lower portion thereof below the line 144 which is equal to the cross-sectional area of the adjacent lower portion of the other half 156. Consequently when the water level in the tank 12 is at or below the line 144, the center of gravity of the tank and included water remains within the central plane 152, and the tank 12 remains in the upright position with the portions 110 and 116 of the rockers 22 and 24 respectively resting on the tops of the support frames 14 and 16 respectively. The upper portion of the cross-sectional area of the front half 154 of the tank 12 as defined by the square 146 is of greater area than the adjacent portion of the circle 138. Consequently, as the water level within the tank 12 rises above the central axis 140 and the line 144, the center of gravity of the tank and included water begins shifting laterally or to the right of the central plane 152 as viewed in FIG. 8. This causes the tank 12 to rotate very slightly onto the intermediate portions 114 and 120 of the rockers 22 and 24 as the water level continues to rise. Eventually, a water level is reached which causes a relatively abrupt rotation of the tank as the rockers 22 and 24 roll over their intermediate portions 114 and 120 respectively and onto their opposite end portions 112 and 118 respectively. As this happens the teeth 34 and 44 of the rockers 22 and 24 engage with the mating teeth 42 and 48 within the top beams 36 and 52 of the support frames 14 and 16 to prevent slippage of and to provide a positive rolling action of the rockers 22 and 24. The tank 12 comes to rest in a tilted position as shown in FIG. 2, at which point the opening 126 is disposed near the bottom of the tank and the water is dumped through the opening 126 and out of the tank 12.

When substantially all of the water has been discharged from the tank 12, the completely enclosed bottom of the tank which weighs more than the partially open top of the tank causes the tank to rotate in the reverse direction so that the rockers 22 and 24 roll over their intermediate portions 114 and 120 respectively and back onto the end portions 110 and 116 respectively to assume the upright position. At that point water discharged from the device 128 again falls through the opening 126 and begins to fill the tank. The tank 12 continues to fill, roll to the tilted position and dump its contents, then roll back to the upright position automatically as long as water is supplied from the device 128. Due to the action of the rockers 22 and 24 which roll on the tops of the support frames 14 and 16 rotation of the tank 12 into the tilted position and back into the upright position occurs in controlled and relatively gentle fashion despite the fact that such movements are rather abrupt, particularly when the tank rolls into the tilted position to dump the water. Of considerable importance is the fact that bumpers or other devices are not needed to slow down or stop the tank as it rolls into and assumes the tilted position. Likewise bumpers, springs or similar devices are not required to control the tank 12 as it rolls back into the upright position.

The elongated housings 86 and 102 comprising a part of the means for adjustably mounting the rockers 22 and 24 on the opposite ends 18 and 20 of the tank 12 extend across the widths of the ends 18 and 20 and define axes of movement for the rockers 22 and 24 relative to the ends 18 and 20 which are disposed in the vicinity of the central axis 140 of the tank 12 and which are generally parallel to the outer side 148 of the square 146 forming a portion of the cross-sectional shape of the tank 12 so as to be generally horizontal when the tank is in the upright position. Turning of the cranks 96 and 106 varies the positions of the rockers 22 and 24 across the widths of the ends 18 and 20 of the tank 12, thereby varying the amount to which the center of gravity of the tank and included water is laterally shifted as the water level rises in the tank. This adjustment enables the operator to dump the contents of the tank for different water levels therein, but mainly provides adjustment which is desirable to optimize the dumping action of the tank for varying or changing conditions in the flush tank system which may occur over a period of time.

While the invention has been particularly shown and described with reference to a preferred embodiment thereof, it will be understood by those skilled in the art that various changes in form and details may be made therein without departing from the spirit and scope of the invention.

What is claimed is:

1. A flush tank system comprising the combination of:

a tank having a pair of opposite ends and an opening therein between the opposite ends, the tank being configured to laterally shift the center of gravity thereof as the tank is filled with fluid while in an upright position;

a pair of rockers, each having an outer surface having a relatively greatly curved portion thereof between opposite relatively slightly curved portions, the pair of rockers being coupled to the tank at the opposite ends thereof; and a pair of support means disposed to receive the outer surfaces and to support different ones of the pair of rockers thereon and the tank extending therebetween, each of the rockers being operative to rock on its support means from one of the opposite slightly curved portions of the outer surface over the greatly curved portion to the other one of the opposite slightly curved portions to rotate the tank from the upright position into a discharge position when fluid in the tank laterally shifts the center of gravity thereof a given amount and to rock from the other one of the opposite slightly curved portions over the greatly curved portion to said one of the opposite slightly curved portions to rotate the tank from the discharge position back into the upright position after fluid is discharged from the tank.

2. The invention as set forth in claim 1, further including a pair of adjustable mounting means, each mounting a different one of the rockers on a different one of the pair of opposite ends and being operative to adjustably vary the position of the rocker relative to the end.

3. The invention as set forth in claim 1, wherein the outer surface of each rocker is toothed and each of the support means has a toothed surface for engaging the toothed outer surface of one of the rockers.

4. A flush tank system comprising the combination of:

an elongated tank having a pair of opposite ends and being comprised of a pair of halves extending along the length thereof on opposite sides of a plane, one of the halves having an opening therein adjacent the plane and extending along at least a substantial portion of the length of the tank between the opposite ends and a cross-sectional area in the region of the opening which is larger than the cross-sectional area of an adjacent portion of the other one of the halves on the opposite side of the plane;

a pair of support means, each disposed adjacent a different one of the opposite ends of the tank; and a pair of rockers, each mounted on a different one of the opposite ends of the tank and having a rocking surface resting on a different one of the support means and comprised of a pair of relatively slightly curved portions on opposite sides of a relatively greatly curved portion, one of the pair of relatively slightly curved portions of each of the pair of rockers having an orientation relative to the tank which defines an upright position for the tank when resting on the pair of support means and the other one of the pair of relatively slightly curved portions of each of the pair of rockers having an orientation relative to the tank which is different from the orientation of said one of the pair of relatively slightly curved portions which defines a tripped position for the tank when resting on the pair of support means;

whereby the tank normally assumes the upright position and is operative to roll on the rockers to the tipped position whenever the tank is filled through the opening with a fluid to the region of the opening, the tank spilling the fluid therein through the opening when the tank rolls to the tipped position.

5. The invention set forth in claim 4, wherein said one of the halves has a cross-sectional area opposite the opening which is substantially identical to the cross-sectional area of an adjacent portion of the other one of the halves on the opposite side of the plane.

6. The invention set forth in claim 4, wherein the rocking surface of each rocker is toothed and the support means on which each rocker rests has a toothed surface engaging the toothed rocking surface of the rocker.

7. The invention set forth in claim 4, wherein the orientation of said one of the pair of relatively slightly curved portions of each of the pair of rockers is more than 90° C removed from the orientation of said other one of the pair of relatively slightly curved portions.

8. The invention set forth in claim 4, wherein each of the rockers is mounted on an end of the tank by adjustable means operative to locate the rocker at a selected position along an axis adjacent the end and generally perpendicular to said plane of the tank.

9. The invention set forth in claim 8, wherein each of the adjustable means includes a shaft extending in the direction of elongation of the tank and having one end thereof coupled to the rocker, a shaft support coupled to the other end of the shaft, a guide mounted on the end of the tank and operative to slidably mount the shaft support therein, and threaded means mounted within the guide and engaging the shaft support and operative to move the shaft support along the guide when rotated.

10. A flush tank system comprising the combination of:

an elongated tank having a uniform cross-sectional shape along the length thereof between flat opposite ends comprised of three-fourths of a circle of given radius having a center coincident with an axis of elongation of the tank and a square having sides equal to the radius, the square having two inner sides thereof joining the three-fourths of the circle and two outer sides thereof at the outer periphery of the cross-sectional shape, the tank having an opening therein of generally rectangular configuration extending along at least a substantial portion of the length of the tank at one of the two outer sides of the square;

a pair of elongated shafts disposed adjacent the opposite ends of the tank and extending in the direction of elongation of the tank;

a pair of adjustable mounting mechanisms, each mounting a different one of the pair of elongated shafts to a different one of the opposite ends of the tank at one of a plurality of different positions along an axis adjacent the axis of elongation of the tank and generally parallel to said one of the two outer sides of the square of the cross-sectional shape of the tank;

a pair of rockers having generally uniform thickness between opposite inner and outer surfaces and including opposite end portions of relatively slight curvature and an intermediate portion of relatively great curvature extending through an angle of at least 90°, each of the pair of rockers having the inside surface thereof at the intermediate portion joined to the outer side surface of a different one of the pair of elongated shafts so as to dispose one of the end portions thereof adjacent the square of the cross-sectional shape of and the opening in the tank and the other one of the end portions thereof on the opposite side of the elongated shaft from the square of the cross-sectional shape of the tank and generally parallel to said one of the two outer sides of the square; and a pair of support frames disposed at opposite ends of the tank and each having a relatively flat upper surface receiving the outer surface of and supporting a different one of the rockers.

11. The invention set forth in claim 10, wherein each of the pair of support frames has a top member including the relatively flat upper surface, a bottom member opposite the top member and a plurality of legs extending between the top and bottom members, the top and bottom members and the legs defining a relatively thin, generally planar frame which is generally vertically disposed.

12. The invention set forth in claim 10, wherein the outer surface of each rocker has a plurality of teeth spaced therealong and the relatively flat upper surface of each support frame has a plurality of teeth spaced therealong and operative to engage with the teeth on the outer surface of the rocker.

13. The invention set forth in claim 10, wherein each of the pair of adjustable mounting mechanisms comprises a plate of given width disposed against one of the ends of the tank and mounting one of the elongated shafts thereon at a central portion thereof, an elongated housing mounted on the end of the tank, the housing being generally parallel to said one of the two outer sides of the square of the cross-sectional shape of the tank and having a hollow interior which is wider than the width of the plate to permit sliding movement of the plate therealong and a front portion having an opening therein narrower than the width of the plate to retain the plate within the housing and wider than the elongated shaft to permit the elongated shaft to extend therethrough.

14. The invention set forth in claim 13, wherein each of the pair of adjustable mounting mechanisms includes a threaded shaft rotatably mounted in and extending along the length of the housing and means coupled to the threaded shaft for rotating the shaft, and wherein the plate has a threaded aperture therein for receiving the threaded shaft.

15. A flush tank system comprising the combination of:

a tank having a pair of opposite ends and an opening therein between the opposite ends, the tank being configured to laterally shift the center of gravity thereof as the tank is filled with fluid while in an upright position;

a pair of supports disposed adjacent different ones of the pair of opposite ends of the tank, each of the supports having an engaging portion thereon; and a pair of rocker means coupled to different ones of the pair of opposite ends of the tank, each of the rocker means having an engaging portion in contact with the engaging portion of a different one of the supports to form a different support-rocker means combination, one of the engaging portions of each support-rocker means combination being of varying curvature, the rocker means being operative to permit the tank to movably assume a first position and to allow the tank to rotate in a second position in response to a lateral shift in the center of gravity of the tank.

16. The invention as set forth in claim 15, wherein the engaging portion of each of the pair of rocker means is comprised of a pair of relatively slightly curved portions on opposite sides of a relatively greatly curved portion.

* * * * *

UNITED STATES PATENT AND TRADEMARK OFFICE

CERTIFICATE OF CORRECTION

PATENT NO. : 4,107,796

DATED : August 22, 1978

INVENTOR(S) : Joel L. Nafziger

It is certified that error appears in the above-identified patent and that said Letters Patent are hereby corrected as shown below:

Column 7, line 32, after "90°", strike "C". Column 9, line 3, after "portion", delete "thereon".

Signed and Sealed this

*Sixth* Day of *March 1979*

[SEAL]

*Attest:*

RUTH C. MASON
*Attesting Officer*

DONALD W. BANNER
*Commissioner of Patents and Trademarks*